United States Patent [19]

Bitko

[11] 4,260,970

[45] Apr. 7, 1981

[54] POSITION INSENSITIVE MERCURY RELAY SWITCH

[75] Inventor: Sheldon S. Bitko, East Brunswick, N.J.

[73] Assignee: Fifth Dimension, Inc., Trenton, N.J.

[21] Appl. No.: 58,437

[22] Filed: Jul. 18, 1979

[51] Int. Cl.[3] ..... H01H 29/00

[52] U.S. Cl. ..... 335/52; 335/58

[58] Field of Search ..... 335/51, 52, 55, 56, 335/57, 58; 200/209, 210, 214

[56] References Cited

U.S. PATENT DOCUMENTS

| | | | |
|---|---|---|---|
| 3,144,533 | 8/1964 | Donath | 335/51 X |
| 3,380,006 | 4/1968 | Donath | 335/56 |
| 3,786,217 | 1/1974 | Bitko | 200/210 X |
| 3,867,603 | 2/1975 | Bitko | 200/234 X |
| 4,047,135 | 9/1977 | Stuckert | 335/58 |

*Primary Examiner*—George Harris

*Attorney, Agent, or Firm*—Burns, Doane, Swecker & Mathis

[57] ABSTRACT

A position insensitive mercury relay switch includes a generally cylindrical hollow common contact assembly and a pair of stationary contacts disposed respectively at each end of the common contact assembly. An armature movably disposed within the common contact assembly establishes electrical contact between the common contact assembly and one of the stationary contacts, in dependence upon the position of the armature. Glass insulators are sealingly engaged to the ends of the common contact assembly and the stationary contacts to insulate the respective contacts from one another. The glass insulators also forms bearings which maintain the armature radially spaced from the common contact assembly. The common contact assembly includes an outer sleeve made from a magnetic material which forms a good seal with the glass insulators, and an inner sleeve made from a mercury wet material. The armature includes an internal or external channel which provides for mercury communication between the common contact assembly and the stationary contacts. The armature can also include permanent magnets for maintaining the armature in one of its two end positions.

22 Claims, 12 Drawing Figures

FIG 4
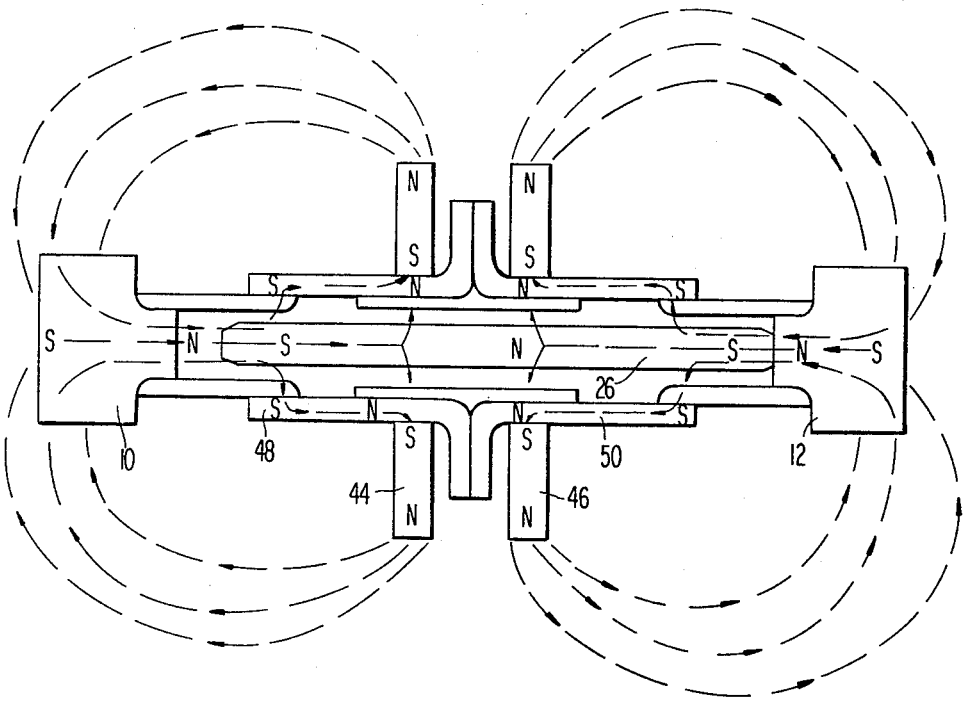
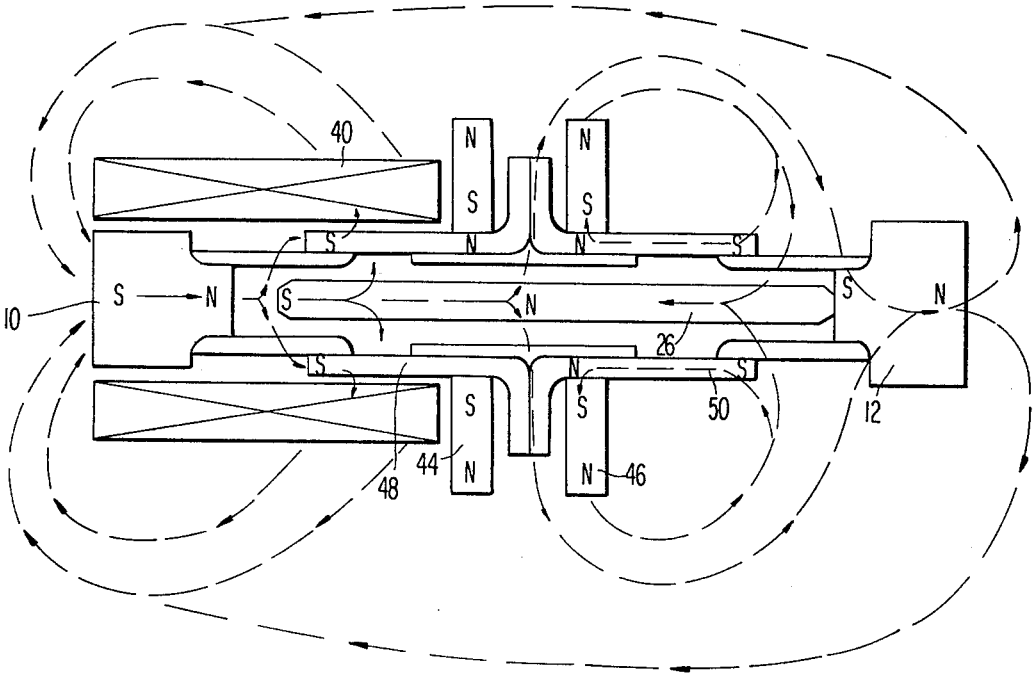
FIG 5

FIG 6
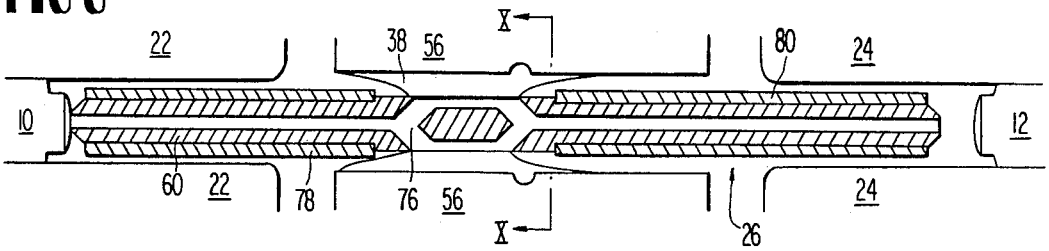
FIG 7
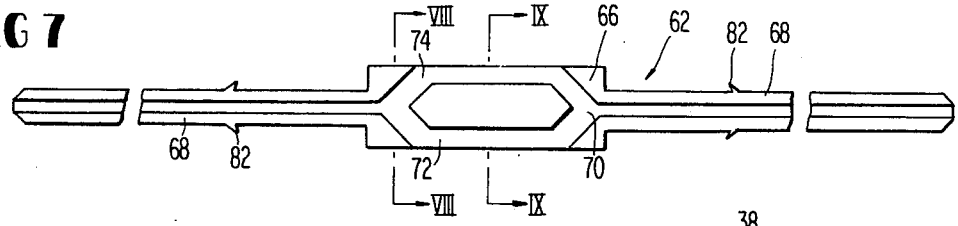
FIG 8
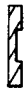
FIG 9
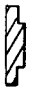
FIG 10
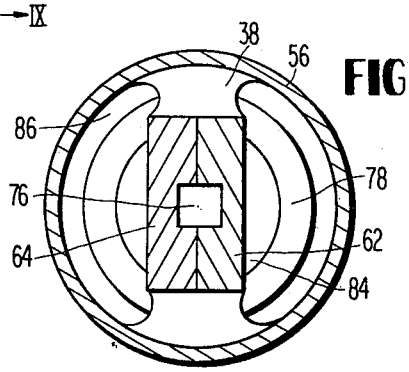
FIG 11
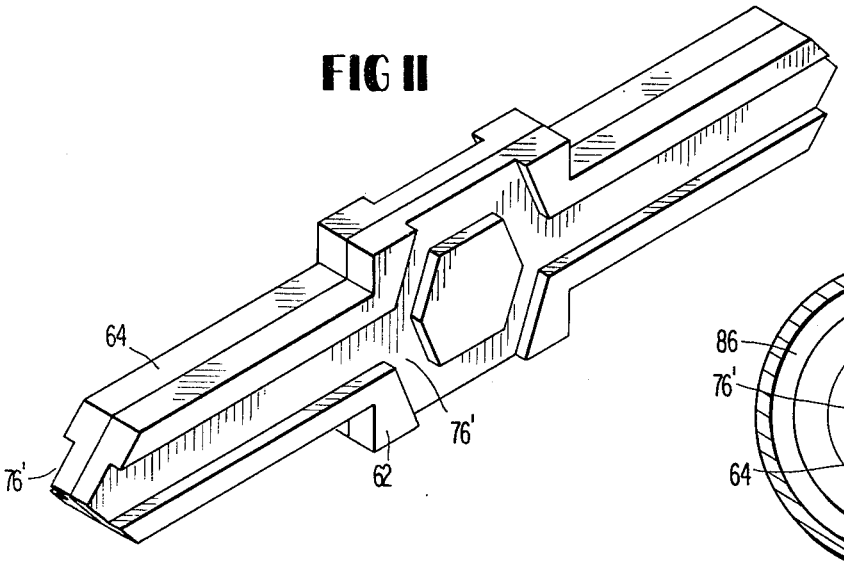
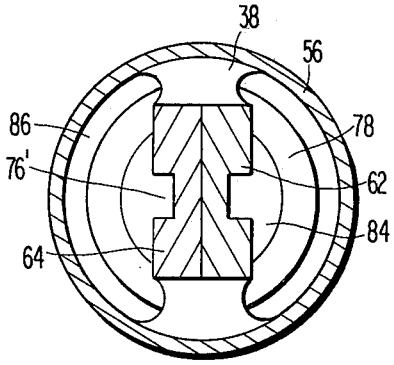
FIG 12

POSITION INSENSITIVE MERCURY RELAY SWITCH

BACKGROUND OF THE INVENTION

The present invention relates to a miniature mercury switch, and more particularly to a position insensitive mercury switch employing an elongated armature which is movable between first and second positions in an enclosed housing.

Mercury relay switches of the type to which the invention pertains generally include a hollow, cylindrical electrically conducting component which forms the common contact of the switch. A stationary contact is disposed at each end of the common contact and insulated therefrom. The stationary contacts are conventionally supported in an insulating sleeve which is hermetically sealed to the common contact to form a sealed enclosure within the hollow portion of the common contact. A movable elongated armature, or shuttle, is located within this enclosure. The armature can be moved longitudinally from one end of the enclosure to the other by means of an electromagnetic oil assembly which surrounds the common contact. Depending upon the position of the armature, electrical contact is established between the common contact and one of the stationary contacts by means of the armature.

A thin film of liquid mercury is placed within the enclosure to ensure good electrical contact between the armature, the common contact, and the stationary contacts. For proper operation of the mercury switch, the surfaces of the stationary contacts, common contact and armature should be mercury wettable to provide the proper electrical contact. However, to avoid mercury shorting of the stationary contacts and the common contact, the material which insulates them from one another should be non-mercury wettable. Glass has been found to be an insulator which is suitable for this purpose. Mercury relay switches of this type are disclosed, for example, in commonly assigned U.S. Pat. Nos. 3,144,533, 3,786,217 and 3,867,603. The present invention constitutes an improvement upon the relay switches disclosed in those patents.

Mercury relay switches of the type described provide a miniature switch having numerous applications in a variety of DC and RF environments. These switches are capable of performing over 100,000,000 switching cycles before replacement of the switch is necessitated. One reason contributing to the need to replace the mercury relay switch is the increase in time it takes the armature to move from operative contact with one stationary contact to the other in response to an electromagnetic command signal after many cycles of use. In addition, the armature may fail to respond to a command signal after it has been idle for a long period of time.

A platinum-iridium alloy is commonly used to make the common contact, since this is a material which is mercury wettable, has a suitable coefficient of expansion for glass sealing and is nonmagnetic. One property of this alloy is its ability to combine with mercury to form a platinum-mercury amalgam. This amalgam thickens and increases viscosity with the passage of time and forms a very thick liquid at the interface of the common contact and the mercury film.

The two predominant forces acting upon the armature during the operation of the mercury switch are the surface tension of the mercury film between the armature and the common contact, and the magnetic forces produced by the biasing magnets. These forces can pivot the armature and pull it close to the surface of the common contact, particularly following long periods of storage or non-use of the mercury switch. If the armature comes too close to the common contact, it will become embedded in the platinum-mercury amalgam and be unable to move within the interior of the switch.

The formation of the platinum-mercury amalgam can be avoided by using different alloys to form the common contact. However, the wetting characteristics of other alloys which can be used to form the common contact are generally not as good as those of platinum alloys.

Furthermore, the viscosity of mercury is inversely proportional to the thickness of the film between the common contact and the movable armature. If the armature is drawn closer to the common contact, such as during non-use periods of the switch, the viscosity of the mercury film increases substantially to a point where it inhibits movement of the armature. The ability of the armature to move rapidly from one stationary contact to the other is thereby reduced on the first few operations after substantial non-use. Only after a few switching operations will the viscosity of the mercury film be restored to its initial value to thereby enable relatively rapid movement of the armature to take place.

It would be advantageous to be able to overcome the effects of these properties of mercury on the operation of the switch, and it is therefore a general object of the present invention to provide a novel mercury switch having an increased shelf life.

It is another object of the present invention to provide a novel mercury relay switch in which the movable armature is maintained in a spaced relationship from the common contact to thereby keep the viscosity of the mercury film low.

It is a further object of the present invention to provide a novel mercury relay switch in which readily available alloys can be used to form the common contact without having the armature become embedded in an amalgam at the interface of the common contact and mercury film after prolonged non-use of the switch.

Due to the nature of the materials used to provide proper functioning of the prior art mercury relay switches, the fabrication of the switches requires a highly skilled operation. Among the criteria for proper operation of the switch, the common contact must be non-magnetic to avoid adverse influence on the movement of the armature, mercury wettable to provide a good electrical contact with the armature, and sealable to glass to provide a hermetically sealed enclosure which inhibits leaking of air into the switch. In addition, it is desirable to use a material for the common contact which has a coefficient of expansion close to that of the glass which forms the insulator material in the relay switch, to avoid imparting stress to the glass-common contact seal during manufacture or under changing temperature conditions. As discussed previously, platinum has been found to be the most suitable material for the common contact, since it is easily mercury wettable, is non-magnetic, and has a coefficient of expansion sufficiently close to certain glasses which are used as insulators in the mercury switches. However, platinum will not adhere to glass in a manner which forms a suitable hermetic seal. In order to form a metal-glass seal, it is a common practice to oxidize the metal, since this procedure allows a chemical bond to be formed between the sealing metal and glass, which is a solution of metallic oxides. However, platinum is not suitably oxidizable and therefore not susceptible to being sealed to the glass through this conventional technique.

Therefore, in order to effect a hermetic seal between the glass insulator and the platinum common contact, an oxidizable metal is first plated and then diffused into the common contact. During this diffusion process, it is necessary to insure that the oxidizable metal is diffused only into the outside surface of the common contact. If the oxidizable metal should penetrate to the inner surface of the contact, the platinum will no longer be mercury wettable and therefore will not provide a satisfactory film of mercury for the switch operation. In order to render the platinum common contact oxidizable and maintain its interior surface mercury wettable during manufacture of the mercury relay switch, the ends of the common contact are capped with rubber pressure plates prior to plating. The common contact is then nickel plated and heated in a hydrogen atmosphere for a period of time sufficient to diffuse the nickel into the exterior surface of the common contact. If the diffusing process is carried on for too long a period of time, the nickel will diffuse through the thickness of the common contact and be present at the interior surface of the contact. Therefore, it is necessary to precisely control the equilibrium condition of the diffusing process. After the nickel has been diffused into the exterior surface of the common contact, it is oxidized to enable the contact to be sealed to the glass insulator.

It is desirable to reduce the number of skilled operations required during the manufacture of the mercury switch, to reduce the time and cost of production. However, the previously noted criteria relating to the properties of the common contact must be met.

It is therefore another object of the present invention to provide a novel position insensitive mercury relay switch in which the number of highly skilled operations required to produce the switch is reduced.

It is yet a further object of the present invention to provide a novel common contact assembly for a mercury relay switch, which contact assembly does not require special oxidizing procedures to enable the contact to be sealed to the glass insulator.

It is still another object of the present invention to provide a novel position insensitive mercury relay switch which is less expensive and easier to produce than prior art mercury relay switches.

As discussed previously, the position of the armature within the sealed enclosure of the switch is controlled by means of an electromagnetic control coil. The strength of the magnetic field produced by the coil, and hence the amount of force necessary to shift the armature, is a function of the magnetic reluctance of the path through which the magnetic flux flows. For a coil having a limited size and a fixed number of coil turns, the magnetomotive force produced by the coil is proportional to the power supplied to the coil. If the operating force requirements of a switch are relatively high, it becomes necessary to provide power to the coil by means of a solid state device, such as a coil driver, in order to operate the switch in response to the output signals from a transistor-transistor-logic (TTL) control circuit. This necessity is due to the fact that the output signals from the logic circuit are not capable of directly driving the electromagnetic coils of the switch.

It is therefore desirable to reduce the magnetic reluctance within the switch to thereby reduce the amount of force required by the switch for operation. This will allow the switch to be directly driven by the output signals from TTL logic circuits, further decreasing the cost of the switch in many applications by eliminating the need for coil drivers.

In addition to the electromagnetic coil, the magnetic circuit of the mercury relay switch can also employ an external permanent magnet. The permanent magnet provides a magnetic field which maintains the armature in operative contact with the selected one of the stationary contacts, to thereby render the switch position insensitive. The permanent magnet also functions to magnetically bias the armature, so that the armature will be shifted in the proper direction when the electromagnetic coil is energized.

Due to possible interference from the magnetic field produced by the external permanent magnet, the applicability of the mercury relay switch is limited in certain radio frequency (RF) environments. Furthermore, the external magnet reduces the amount of space available for the electromagnetic coils. In view of the limited coil size, the applicability of the mercury relay switch in certain low power DC environments is also limited.

It is therefore another object of the present invention to provide a novel mercury relay switch having a magnetic circuit with increased efficiency, to thereby reduce the amount of power necessary to operate the switch.

It is still a further object of the present invention to provide a novel common contact assembly for a mercury relay switch which reduces the reluctance in the magnetic circuit of the switch.

It is yet another object of the present invention to eliminate the external permanent magnet in a mercury relay switch and thereby increase the number of applications of the switch.

These, as well as other objects and advantages of the present invention, will become apparent to one of ordinary skill in the art to which the present invention pertains upon a perusal of the following description when taken in conjunction with the accompanying drawings.

BRIEF DESCRIPTION OF THE DRAWINGS

FIG. 4 is a cross sectional view of the mercury relay switch of FIG. 1 illustrating the lines of flux produced in the magnetic circuit of that switch;

FIG. 5 is a cross sectional view of the mercury relay switch of FIG. 1 illustrating the lines of flux produced by the electromagnetic coil;

FIG. 6 is a cross sectional view of a preferred embodiment of an armature which can be used in the mercury relay switch illustrated in FIG. 1;

FIG. 7 is a side view of one of the lamination layers of the mercury wettable portion of the armature illustrated in FIG. 6;

FIG. 8 is a cross sectional end view taken along the line VIII—VIII of FIG. 7;

FIG. 9 is a cross sectional end view of the armature section taken along the line IX—IX of FIG. 7;

FIG. 10 is a cross sectional end view of the armature taken along the line X—X of FIG. 6;

FIG. 11 is a perspective view of a second preferred embodiment of an armature; and FIG. 12 is a cross sectional end view of the second preferred embodiment of the armature.

DETAILED DESCRIPTION OF THE PREFERRED EMBODIMENT

The present invention relates particularly to miniature magnetic mercury relay switches, although its applicability is not limited to these types of switches. One example of a miniature mercury relay switch constructed in accordance with the present invention is illustrated in FIG. 1, the illustration in FIG. 1 being a cross sectional view along the length of the switch.

Figure 1:
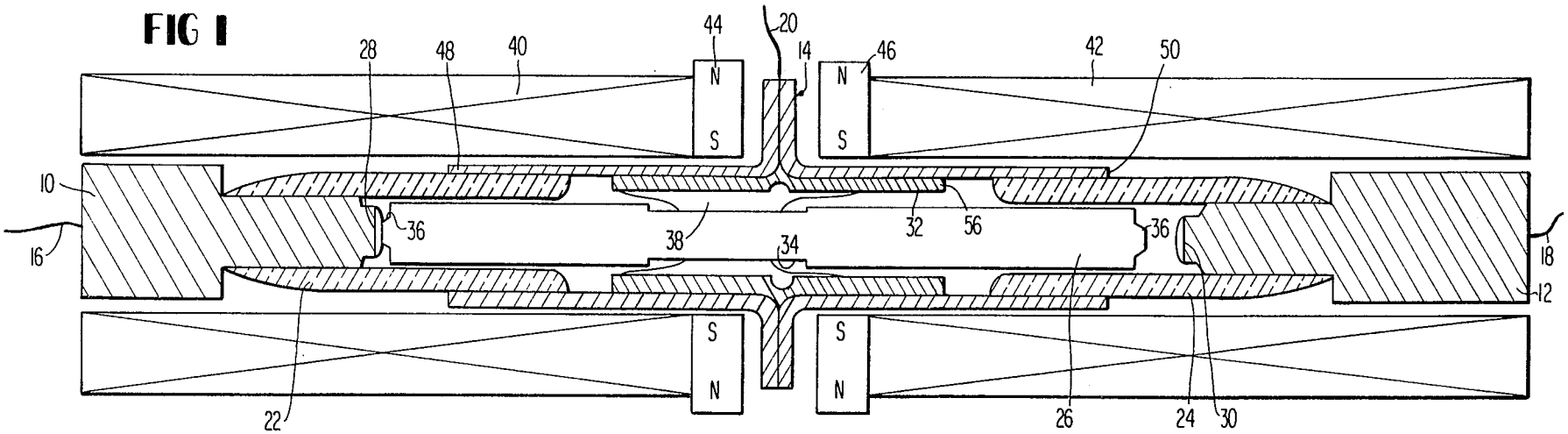
FIG. 1 is a cross sectional view along the length of a mercury relay switch constructed in accordance with the present invention.

Referring now to FIG. 1, the mercury relay switch includes a pair of pole pieces 10, 12 which form stationary contacts. The switch also includes a common contact 14. Each of the contacts 10, 12, 14 has an electrical lead 16, 18, 20, respectively, connected thereto. Each of the contacts 10, 12, 14 is insulated from the other contacts by means of tubular insulators 22, 24. The common contact 14 can be alternately electrically connected to one of the stationary contacts 10, 12 by means of an elongate electrically conductive armature 26.

In order to insure good electrical contact between the stationary contacts 10, 12, the common contact 14 and the armature 26, the interior end surfaces 28, 30 of the stationary contacts 10, 12, the interior surface 32 of the common contact 14, and at least a portion of the exterior surface 34 of the armature 26 are made of a mercury wettable material. The end surfaces 36 of the armature 26 are also mercury wettable. A thin film of mercury 38 is coated on the interior surface 32 of the common contact 14, and thin films of mercury are coated on the mercury wettable surfaces 28, 30 of the stationary contacts 10, 12.

In the position shown in FIG. 1, in which the armature 26 is shifted to the left as viewed in the figure, electrical contact is established between the common electrical lead 20 and one of the leads 16 associated with a stationary contact, through the current path including the common contact 14, the film of mercury 38 on the interior surface of the common contact 14, the electrically conductive armature 26, the thin film of mercury bridging the armature 26 and the stationary contact 10, and the stationary contact 10 itself.

Actuation of the mercury relay switch to alternately connect the common contact 14 to one of the stationary contacts 10, 12 is carried out by a magnetic circuit. The magnetic circuit can include a pair of electromagnetic coils 40, 42 which surround the common contact 14 and the armature 26 and are respectively disposed on either side of the center of the switch.

The magnetic circuit of the switch can also include a permanent magnet which functions to bias the armature 26 and maintain it in contact with one of the stationary contacts 10, 12. In the preferred embodiment illustrated in FIG. 1, the permanent magnet includes a pair of radially polarized annular magnets 44, 46. The outer peripheries of the annular magnets 44, 46 are of one magnetic polarity, and the inner peripheral surfaces of the magnets have an opposite magnetic polarity. A mercury relay switch having a radially polarized annular magnet is disclosed, for example, in U.S. Pat. No. 3,380,006, commonly assigned herewith.

The electromagnetic coils 40, 42, the permanent magnets 44, 46 and the armature 26 operate basically as a solenoid to establish electrical contact between the common contact 14 and one of the stationary contacts 10, 12. For example, if a pulse of current of proper direction is applied to the right hand electromagnetic coil 42, as viewed in FIG. 1, the coil 42 will produce a magnetic field which will pull the armature 26 to the right as viewed in the figure and establish electrical contact between the common contact 14 and the right-hand stationary contact 12. In the same manner, the left-hand electromagnetic coil 40 operates to shift the armature to the left and establish electrical communication between the common contact 14 and the left-hand stationary contact 10.

Alternately, the coils can be operated in a reverse fashion to push the armature from one side of the switch to the other. For example, if the left-hand magnetic coil 40 is pulsed with a reverse polarity current from that used in the operation described previously, an armature on the left side of the switch will be shifted to the right. The right-hand coil 42 can be operated in this manner to shift the armature to the left.

In addition, both coils 40, 42 can be operated conjunctively in a push-pull fashion, to thereby reduce the power requirements of the switch.

The permanent magnets 44, 46 maintain the armature 26 in contact with one of the stationary contacts 10, 12 after the armature 26 is moved to the selected contact by means of the electromagnetic coils 40, 42. This function of the permanent magnets operates to render the mercury relay switch position insensitive, i.e., electrical communication between the common contact 14 and a selected one of the stationary contacts 10, 12 will be maintained regardless of the position of the switch. In addition, the surface tension of the mercury film 38 attached to the common contact 14 renders the mercury position insensitive to further aid in maintaining the switch position insensitive.

In order to prevent undesirable shorting of the common contact 14 with either or both of the stationary contacts 10, 12 by the mercury within the switch, the surface of the insulators 22, 24 which separate the contacts must be non-mercury wettable. Therefore, glass is chosen as a suitable material from which the insulators 22, 24 are made, since it is both electrically insulating and non-mercury wettable. The tubular glass insulators 22, 24 are hermetically sealed along their interior surfaces at one end thereof to the stationary contacts 10, 12 respectively. The insulators 22, 24 are likewise hermetically sealed along their exterior surfaces at the other end thereof to the common contact 14. The stationary contacts 10, 12, the common contact 14 and the tubular glass insulators 22, 24 form a hermetically sealed enclosure in which the armature 26 and mercury film 38 are enclosed. The hermetically sealed enclosure can be filled with an inert or reducing gas to reduce the deleterious effects of exposure to air upon the mercury wetting and electrically conducting properties of the switch components.

As illustrated in FIG. 1, the armature 26 has a length which is greater than the spacing between the two insulators 22, 24. The inside diameter of the glass insulators is only slightly greater than the outside diameter of the armature, and each of the ends of the armature 26 is respectively disposed in the bore formed in one of the tubular insulators 22, 24. In addition to providing a support for the stationary contacts 10, 12 and isolating the stationary contacts from one another and from the common contact 14, the tubular glass insulators 22, 24 also function as bearings which are operable to maintain the armature 26 radially spaced from the interior surface of the common contact 14. It will be appreciated that under ideal conditions the force balance is such that the armature is positioned along the axis of the switch without contacting the bearings 22, 24. However, in cases of departure from the ideal, the bearings constrain the armature to a generally central position. The glass bearings have relatively low friction surfaces which are operable to increase the sensitivity of the armature 26 to the magnetic fields generated by the electromagnetic coils 40, 42, and thereby reduce the response rate of the mercury relay switch.

By supporting the armature 26 in this manner, the insulators 22, 24 prevent the armature 26 from getting too close to the interior surface of the common contact 14 and thereby prevent the armature 26 from having to push its way through a very thin, low viscosity film or through an amalgam formed at the interface of the common contact 14 and the mercury film 38. Thus, the glass insulator bearings 22, 24 function to reduce the response time of the switch and increase its shelf life by providing a low friction surface over which the armature 26 rides and by maintaining the armature 26 spaced from the interior surface of the common contact 14.

As noted previously, the common contact 14 should possess a number of properties which will achieve optimum operation of the switch. The common contact 14 should have an interior surface which is mercury wettable, to establish good electrical contact with the armature through the mercury film 38. The common contact 14 must also be capable of forming a strong hermetic seal with the glass insulators 22, 24, to provide a rugged switch structure and to prevent exposure of the mercury wettable surfaces to air. In addition, the material forming the common contact should have a coefficient of thermal expansion as close as possible to that of the glass used to form the insulators 22, 24.

Figure 2:
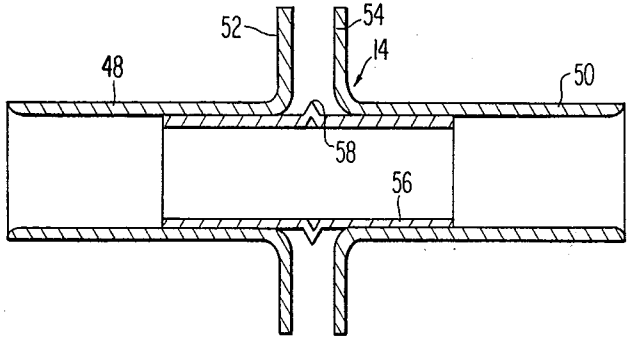
FIG. 2 is a cross sectional view of the common contact assembly for the mercury relay switch illustrated in FIG. 1, with the two outer sleeves of the assembly shown separated from one another.

In order to provide a common contact 14 which possesses all of these features and yet reduce the time and cost of manufacture, the common contact 14 is constructed as a three piece assembly in accordance with another aspect of the present invention. Such a contact assembly is illustrated in partially disassembled form in FIG. 2. Referring now to FIGS. 1 and 2, the common contact assembly 14 includes a pair of coaxially disposed outer sleeves 48, 50. Each sleeve includes a radial flange 52, 54 which is disposed at a right angle to the cylindrical portion of the sleeve. Disposed within the outer sleeves 48, 50, and coaxial therewith, is an inner sleeve 56. The inner sleeve 56 has a length which is less than the combined length of the two outer sleeves 48, 50, and is preferably approximately equal to the length of one outer sleeve 48 or 50. Disposed intermediate the ends of the inner sleeve 56, and preferably centrally thereof, is a radial projection 58 which surrounds the inner sleeve 56. The radial projection 58 can be integral with the inner sleeve 56 or it can be a separate element which is attached to the inner sleeve 56. The outside diameter of the radial projection 58 is greater than the inside diameter of the outer sleeves 48, 50.

During manufacture of the common contact assembly 14, the outer sleeves 48, 50 are fitted over the ends of the inner sleeve 56 with their flanged ends facing one another, as illustrated in FIG. 2. The flanges 52, 54 of the outer sleeves 48, 50 are brought into engagement with one another, and pinch the radial projection 58 in the nip formed between the two flanges 52, 54, as illustrated in FIG. 1. The flanges 52, 54 are then welded to each other, or otherwise suitably attached, to lock the inner sleeve 56 in place between the two outer sleeves 48, 50, and to form a unitary common contact assembly.

The outer sleeves 48, 50 are constructed of a material having good glass sealing properties and also having a coefficient of thermal expansion which is as close as possible to that of the glass used to form the insulators 22, 24. A 42% nickel -6% chromium alloy can be used to form the outer sleeves 42, 50, for example. Commercially available examples of such an alloy include Allegheny Ludlum Sealmet No. 4, Carpenter 42-6 and Sylvania 4. Other suitable metals having good glass sealing characteristics and an acceptable coefficient of thermal expansion will be apparent to those of ordinary skill in the art.

The inner sleeve 56 of the common contact assembly is made from a mercury wettable material. One commercially available material which has been found to be particularly suitable is a 67% nickel, 30% copper, 2½% iron alloy sold under the trademark MONEL 400. This material is particularly desirable because its wetting properties can be controlled to such a degree that diffusion of the common contact material into the mercury is substantially reduced and therefore the formation of an amalgam at the interface of the common contact and the mercury is inhibited.

The inner sleeve 56 of the common contact assembly 14 is preferably pre-mercury wetted prior to construction of the common contact assembly. This pre-mercury wetting can be carried out by immersing the sleeve in a bath of mercury, agitating the mercury and heating the sleeve to cause the mercury to wet thereto.

The multi-component common contact assembly thus avoids the constraints of finding a single material which is mercury wettable, forms a good seal with glass and has a coefficient of thermal expansion which very closely matches that of the glass insulator. The illustrated contact assembly allows a first component to be used which is capable of forming a good seal with the glass insulators and which has the desired coefficient of thermal expansion. The inner sleeve 56 is made from a mercury wettable material and need not form a good seal with the glass insulators since it is rigidly locked in place within the mercury relay switch by means of the radial projection which is pinched within the nip formed by the outer sleeves. The need to oxidize the exterior surface of the common contact while maintaining the mercury wettability of its interior surface during the manufacture of the mercury relay switch is thus avoided by the common contact assembly of the present invention. The inner and outer sleeves of the contact assembly can be easily and inexpensively produced and thereby reduce the cost of manufacture of the switch by obviating the need for skilled operations.

In addition to reducing the time and cost of manufacture of the mercury relay switch, the multiple component common contact assembly of the present invention also operates to increase the efficiency of the magnetic circuit of the switch. The function of the common contact assembly in achieving this advantage will be explained with reference to FIGS, 3, 4 and 5.

Figure 3:
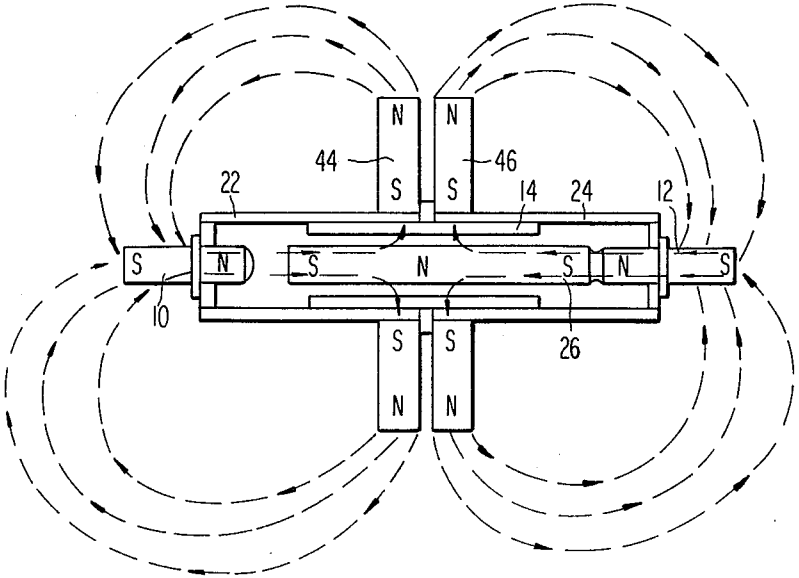
FIG 3 PRIOR ART
FIG. 3 is a cross sectional view of a prior art mercury relay switch illustrating the lines of flux produced by the permanent magnet associated with the switch.

Referring now to FIG. 3, the magnetic field produced by the radially polarized annular magnets is illustrated for a prior art mercury relay switch. In the embodiment illustrated in FIG. 3, the outer peripheries of the radially polarized magnets are magnetic north poles, and the interior circumferential surfaces of the magnets are magnetic south poles. The external lines of magnetic flux flow from the outer north pole to the inner south pole. Since the parallel lines of flux from the two permanent magnets 44, 46 repel one another, the magnetic field is deflected outwardly towards the stationary contact units 10, 12, respectively. The stationary contact units are constructed with a magnetically soft material and therefore become polarized with the external end of the contact unit assuming a south polarity and the internal end of the contact unit assuming a north polarity. The magnetic flux flows from the stationary contact units 10, 12 through the armature 26 and back to the south poles of the radially polarized magnets. The flow of magnetic flux through the armature 26 causes the two ends of the armature to assume a south polarity and the central portion of the armature to assume a north polarity.

The magnitude of the poles assumed by the stationary contacts 10, 12 and the armature 26 is a function of the amount of flux flowing in the magnetic field. The attractive or repelling forces between the stationary contacts 10, 12 and the armature 26 are proportional to the strength of the magnetic poles and hence the number of lines of flux.

The number of lines of flux $\phi$ is defined as $$\phi = F/R$$

where

F is the magnetomotive force producing the magnetic field, and

R is the reluctance of the magnetic circuit.

It can be seen therefore that the number of lines of flux in the magnetic field is inversely proportional to the reluctance of the magnetic circuit. The reluctance is defined as $$R = l/\mu A$$

where $l$ is the length of a magnetic element in the magnetic circuit,

A is the cross sectional area of the magnetic element, and $\mu$ is the permeability of the magnetic element.

From the foregoing, it can be seen that increasing the length of a magnetic element increases the magnetic reluctance in the circuit, whereas increasing the cross sectional area of the element decreases the reluctance in the circuit for a constant magnetic permeability.

Referring to the mercury relay switch illustrated in FIG. 3, the reluctance of the magnetic circuit in the left-hand portion of the switch is greater than that in the right-hand portion of the switch. This is due to the air gap present between the left-hand end of the armature 26 and the inner end of the stationary contact 10. The magnetic permeability of air is much less than that of the materials in the armature 26 and the stationary contacts 10, 12. Due to the increased reluctance provided by the air gap, the attracting force between the stationary contact 10 and the left-hand end of the armature 26 is not as great as the attracting force between the stationary contact 12 and the right-hand end of the armature 26. Therefore, the magnetic circuit operates to maintain the armature 26 in its illustrated right-hand position. The magnetic circuit operates in the same fashion to maintain the armature 26 in its left-hand position when it has been shifted to the left by means of the electromagnetic coils (not shown).

As noted previously, an increase in the cross sectional area of the magnetic elements in the magnetic circuit will decrease the reluctance of the circuit. In the multi-component common contact assembly of the present invention, the outer sleeves 48, 50 are preferably made from a magnetically soft material. The presence of this magnetically soft material in the magnetic circuit functions to increase the cross-sectional area of the magnetic elements in the circuit without increasing the length or size of the elements in the circuit, to thereby reduce the reluctance and increase the efficiency of the magnetic circuit. The reluctance is further reduced by increasing the cross-sectional area of the pole pieces 10, 12 in the region external of the glass insulators 22, 24.

Referring now to FIG. 4, it can be seen that the magnetic flux produced by the permanent magnets 44, 46 flows not only through the pole pieces 10, 12 and the armature 26, but also through the cylindrical portions of the outer sleeves 48, 50. These sleeves provide an additional path for the flow of the magnetic flux and effectively increase the cross-sectional area of the magnetic elements between the stationary contacts 10, 12 and the permanent magnets 44, 46.

In view of the decreased reluctance of the magnetic circuit, fewer ampere turns, and hence less power, will be required in the electromagnetic coils 40, 42 to shift the armature 26 from one position to another. The electromagnetic coil increases the magnitude of the attracting force between the stationary contact and the armature 26 on the side of the switch to which the armature is to be shifted, i.e., the left side as viewed in FIG. 4.

Referring now to FIG. 5, the lines of flux generated by the electromagnetic coil 40 are shown for the situation in which the coil 40 is actuated to shift the armature from the right hand to the left hand side of the switch, as viewed in the figure. It can be seen that the lines of flux generated by the coil 40 are parallel to those lines of flux generated by the permanent magnet 44. However, the lines of flux from the coil 40 which pass through the right hand pole piece 12 of the switch oppose the lines of flux generated by the permanent magnet 46. The permanent magnet 46 maintains the armature 26 magnetically biased with a north pole at its central portion and a south pole at its outer end. However, the permanent magnet is not strong enough to maintain the magnetic bias on the pole piece forming the stationary contact 12, and the lines of flux from the electromagnetic coil 40 cause the bias on the pole piece to reverse its polarity. In this situation, the south pole at the interior end of the stationary contact 12 and the south pole on the right hand end of the armature 26 repel one another. This repelling force, when coupled with the attracting force generated by the permanent magnet 44 and the electromagnetic coil 40, causes the armature 26 to shift from the right hand position illustrated in FIG. 5 to its left hand position.

Due to the increased cross-sectional area of the magnetic circuit provided by the outer sleeves 48, 50 and the pole pieces 10, 12, the electromotive force necessary to shift the armature is reduced over the prior art mercury relay switch. Since electromotive force is directly proportional to the number of ampere turns in the coil, the size of the coil can be reduced. Alternatively, the operating power of the coil can be reduced or a combination of ampere turns and operating power can be reduced to provide the optimum result. Therefore, it can be seen that the common contact structure of the present invention provides for increased efficiency of the magnetic circuit as well as for ease of manufacturing and decrease in the cost of the switch.

A twisted armature, such as that shown in the aforementioned U.S. Pat. Nos. 3,786,217 and 3,867,603, can be used in a mercury relay switch constructed in accordance with the present invention. Such an armature has an outside surface which is non-mercury wettable, to allow the armature to float on the mercury film on the interior surface of the common contact. The armature includes a spiral groove, at least a portion of which has a mercury wettable surface to allow for transfer of mercury within the sealed enclosure during relay operations and thereby prevent imbalances or pressure buildup within the relay switch.

While such an armature can be use in a mercury relay switch constructed in accordance with the present invention, it would be advantageous to provide an armature which is easier to manufacture and therefore less expensive. Preferred embodiments of an armature suitable for use with a mercury relay switch constructed in accordance with the present invention are illustrated in detail in FIGS. 6–12.

Referring now to FIGS. 6 and 7, a cross-sectional view of one preferred embodiment of the armature is illustrated. The armature 26 includes an elongate central section 60. The central section 60 can consist of two laminated layers of material 62, 64, as illustrated in FIG. 10.

One of the laminations 62 which form the central section 60 of the armature 26 is illustrated in detail in FIG. 7. The lamination 62 includes a wide central portion 66 and narrow, slightly tapered end portions 68. A substantially longitudinal groove 70 is etched on one side of the lamination 62. The groove 70 is centrally located in each of the narrow end portions 68 of the lamination piece 62. In the wider central portion 66 of the lamination, the groove 70 is bifurcated and includes two parallel portions 72, 74 respectively located on the longitudinal edges of the wide portion 66. Two cross-sectional end views of the lamination piece 26, taken along the sectional lines VIII—VIII and IX—IX, are respectively illustrated in FIGS. 8 and 9 to facilitate an understanding of the position of the groove. The groove 70 has a depth equal to approximately one-half the thickness of the lamination piece 62.

When two lamination pieces 62, 64 are placed together with their respective grooves facing each other, a channel 76 is formed in the interior of the armature 26. This channel 76 provides a path between the common contact inner sleeve 56 and each of the stationary contacts 10, 12. Through the channel 76, mercury can be transferred from the common contact to the stationary contact 10, 12 to thereby provide improved electrical communication between the respective contacts.

Alternatively, the two lamination pieces 62, 64 can be assembled with their unetched flat surfaces together and with the grooves facing outwardly, as illustrated in FIGS. 11 and 12. In this embodiment of the armature, two external channels 76' are formed. This embodiment may offer some advantages over the internal channel embodiment in certain applications since the free surface area of the mercury is increased, i.e. more of the mercury is exposed to the gaseous atmosphere rather than being bounded by the surfaces of the armature channel. The forces due to the surface tension of the mercury are related to the free surface area of the mercury. When the free surface area of the mercury is increased, the surface tension forces are increased. Thus, the tendency for a mercury bridge to form between a stationary contact and the armature when the armature moves away from the contact will be decreased.

The two lamination pieces 62, 64 forming the elongate central portion 60 of the armature 26 can be held together by means of magnetic tubes 78, 80 placed over the narrow end portions 68 of the lamination pieces. The length of the tubings 78, 80 is slightly less than the length of the end portions 68 of the armature laminations, so that when the tubings are brought into engagement with the shoulders formed by the wider portion 66 of the lamination, the narrow end portions 68 of the armature project slightly beyond the outer ends of the tubings 78, 80. These projections of the narrow end portions 68 comprise the impact surfaces of the armature which contact the pole pieces forming the stationary contacts 10, 12.

In order to hold the tubings 78, 80 in place when they are fitted over the lamination pieces, the narrow end portions 68 of the lamination pieces are slightly tapered, to provide an increasingly tighter fit as the tubings are slid toward the wider central portion 66 of the laminations. In addition, the narrow end portions 68 can be provided with splines 82 which provide an additional gripping force to hold the tubings in place.

The air spaces 84 formed between the laminations 62, 64 and the armature tubings 78, 80 and the air spaces 86 between the armature tubings and the common contact inner sleeve 56 provide air passages which allow for free flow of the gas within the sealed enclosure of the switch. Therefore, pressure pumping, i.e., the buildup of gas pressure at one end of the switch enclosure due to entrapment of the gas by the mercury, is substantially prevented, to further increase the ease of movement of the armature and efficiency of operation of the switch.

The tubings 78, 80 are preferably made from a non-mercury wettable material, in order to inhibit the formation of a mercury bridge between the common contact inner sleeve 56 and the stationary contacts 10, 12. The lamination sections 62, 64 of the armature 26 are made from a mercury wettable material. The armature laminations are preferably pre-mercury wetted before being assembled into the armature structure. The previously mentioned nickel-copper alloy sold under the trademark MONEL 400 is particularly suitable for manufacture of the elongate central portion 60 of the armature 26, since its degree of mercury wetting can be controlled. Through control of the degree of wetting, sticking of the mercury wettable impact surfaces of the armature 26 and the stationary contacts 10, 12 can be substantially prevented.

Furthermore, through the provision of a mercury wettable central portion which is surrounded by a non-mercury wettable tubing 78, 80, splashing of mercury, which can occur when an impact surface of the armature 26 is brought into contact with one of the stationary contacts 10, 12, can be substantially inhibited. Since contact is made by two mercury wet materials, rather than between a mercury wet material and a non-wetted material, the surface tension of the mercury keeps the mercury together. In this manner, splashing of the mercury is substantially inhibited, to thereby prevent the mercury from becoming dislodged between the tubings 78, 80 and the glass insulator bearing 22, 24, respectively. Furthermore, only a cylindrical surface is present at the interface of the armature 26 and the glass insulator bearings 22, 24, to thereby facilitate movement of the armature within the switch enclosure. Low friction coatings, for example TEFLON or molybdenum disulfide, can be used on the surfaces of the tubings 78, 80 to further reduce friction between the armature and the bearings.

In addition to being non-mercury wettable, the material which is used to construct the armature tubings 78, 80 can be magnetically soft, with high permeability and high flux saturation. With this manner of construction, the armature 26 is capable of being easily polarized by the permanent magnets 44, 46, as discussed previously, and provides a low reluctance path for the magnetic flux flowing in the magnetic circuit.

Rather than using a magnetically soft material for the armature tubings 78, 80, a magnetically hard material with high residual flux, i.e., a permanent magnet, can be used to construct the tubings. With a magnetically hard material, the armature will be permanently polarized and the radially polarized permanent magnets 44, 46 on the exterior of the switch enclosure can be eliminated, since the permanent magnets in the armature itself will provide the necessary biasing forces. A semi-hard magnetic material with high residual flux can also be used to construct the armature tubings. By eliminating the exterior biasing magnets, the adverse effect of such permanent magnets upon RF signals is reduced, and therefore the applicability of the mercury relay switch in a wider range of different RF environments is enhanced. In addition, a mercury relay switch utilizing an internal permanent magnet constructed in accordance with the present invention can be used in a wider range of DC applications, since more electromagnetic coil volume is provided by the eliminating the exterior biasing magnetics.

It can be seen from the previous description that the preferred embodiments of the armature allow for easy fabrication of the armature. Furthermore, the armature has good magnetic and mercury wetting properties for increased efficiency of operation of the switch.

SUMMARY OF THE OBJECTS AND ADVANTAGES OF THE INVENTION

From the foregoing, it can be seen that the novel mercury relay switch of the present invention provides additional advantages and increased efficiency of operation in relay switches. The use of glass insulator bearings to centrally position the relay armature along the axis of the switch prevents the armature from getting too close to the interior surface of the common contact and thereby reduces forces resisting movement of the armature. In addition, the glass bearing provides a relatively low friction surface over which the armature rides.

The provision of a multi-component common contact assembly substantially reduces the number of skilled operations required to manufacture the mercury relay switch. The need to construct the common contact out of a single material which is mercury wettable, provides a good glass seal, and has a coefficient of expansion close to that of glass has been eliminated. Furthermore, a portion of the common contact assembly can be constructed from a magnetically soft material to increase the cross-sectional area of the magnetic elements present within the magnetic circuit of the relay switch. Thus, the amount of electromotive force necessary to shift the armature from one position to another is reduced.

The preferred embodiments of the armature further decrease the number of skilled operations and manufacturing cost required in production of the relay switch. The armature is easily constructed with an internal or external channel which provides for mercury communication between the common contact assembly and the stationary contacts. Mercury wetted impacter surfaces reduce mercury splashing when the armature is brought into contact with one of the stationary contacts. A cylindrical surface present at the interface of the armature and the glass insulator bearings positions the armature along the axis of the common contact and eases the movement of the armature through the switch enclosure. Use of a permanent magnet to form the armature tubings eliminates the need for exterior biasing magnets and increases the applicability of the mercury relay switch in RF and DC environments.

The present invention may be embodied in other specific forms without departing from the spirit or essential characteristics thereof. For example, a mercury relay switch having a single stationary contact, rather than two opposed stationary contacts, can also be constructed in accordance with the present invention.

The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A position insensitive mercury relay switch, comprising:

a generally cylindrical, hollow common contact assembly;

an elongate armature movably disposed within said common contact assembly;

insulator means sealingly engaged to at least one end of said common contact assembly, said insulator means functioning as a bearing which guides said armature for longitudinal movement and maintains said armature spaced from the inside wall of said common contact assembly;

a stationary contact supported within said insulator means and adapted to be operatively engaged by said armature; and a film of mercury within said common contact assembly for electrically connecting said common contact assembly to said armature.

2. The position insensitive mercury relay switch of claim 1 wherein said common contact assembly comprises:

a first tubular member made from a material which provides a hermetic seal with said insulator means; and a second member received within said first tubular member and made from a material which is mercury wettable.

3. The position insensitive mercury relay switch of claim 2 wherein said first tubular member comprises two sleeves each having a substantially right angled flange at one end thereof, said two sleeves being coaxially joined at their respective flanged ends to form said first tubular member, further wherein said second tubular member comprises a sleeve having a radial projection intermediate the ends thereof, said radial projection being disposed in the nip formed between the two joined flanges of said first tubular member.

4. The position insensitive mercury relay switch of claim 2, wherein said first tubular member is made from a magnetically soft material.

5. The position insensitive mercury relay switch of claim 1 wherein said elongate armature has a channel therein providing mercury communication between said common contact assembly and said stationary contact when said armature is in operative engagement with said stationary contact.

6. The position insensitive mercury relay switch of claim 5 wherein said armature comprises two elongate members each having at least one flat surface with a generally longitudinal groove therein, said elongate members being joined together at their flat surfaces with their respective grooves in registry to form said channel.

7. The position insensitive mercury relay switch of claim 5 wherein said armature comprises two elongate members each having at least one flat surface and a generally longitudinal groove in the surface opposite to said flat surface, said elongate members being joined at their flat surfaces to thereby provide external channels on said armature.

8. The position insensitive mercury relay switch of claim 6 or 7 further including at least one tubing disposed around said elongate members for maintaining said members in their joined relationship.

9. The position insensitive mercury relay switch of claim 8 wherein said elongate members are made of a mercury wettable material and said tubing is made of a non-mercury wettable material.

10. The position insensitive mercury relay switch of claim 8 wherein said tubing is made of a magnetically soft material.

11. The position insensitive mercury relay switch of claim 8 wherein said tubing comprises a permanent magnet.

12. The position insensitive mercury relay switch of claim 1 wherein said insulator means is generally cylindrical in shape and has an axial bore in which said stationary contact is supported, further wherein at least a portion of the external surface of said armature is cylindrical in shape, said cylindrical portion being movably disposed within said bore.

13. A position insensitive mercury relay switch, comprising:

a generally cylindrical, hollow common contact assembly including a first tubular member constructed from a material which provides a hermetic seal with an insulator material, and a second tubular member received within said first tubular member and made from a material which is mercury wettable;

an elongate armature movably disposed within said common contact assembly;

insulator means sealingly engaged to at least one end of said first tubular member of said common contact assembly;

a stationary contact supported within said insulator means and adapted to be operatively engaged by said armature; and a film of mercury within said second tubular member of said common contact assembly for electrically connecting said common contact assembly to said armature.

14. The position insensitive mercury relay switch of claim 13 wherein said first tubular member comprises two sleeves each having a substantially right angled flanged at one end thereof, said two sleeves being coaxially joined at their respective flanged ends to form said first tubular member, further wherein said second tubular member comprises a sleeve having a radial projection intermediate the ends thereof, said radial projection being disposed in the nip formed between the two joined flanges of said first tubular member.

15. The position insensitive mercury relay switch of claim 13, wherein said first tubular member is made from a magnetically soft material.

16. A position insensitive mercury relay switch, comprising:

a generally cylindrical, hollow common contact assembly;

insulator means sealingly engaged to at least one end of said common contact assembly;

a stationary contact supported by said insulator means;

an elongate armature movable disposed within said common contact assembly for operatively engaging said stationary contact, said armature comprising two elongate members each having at least one flat surface and a generally longitudinal groove, said elongate members being joined together at their flat surfaces and said grooves forming at least one channel for providing fluid communication between said common contact assembly and said stationary contact when said armature is in operative engagement with said stationary contact; and a film of mercury within said common contact assembly for electrically connecting said common contact assembly to said armature.

17. The position insensitive switch of claim 16 further including at least one tubing disposed around said elongate members for maintaining said members in their joined relationship.

18. The position insensitive mercury relay switch of claim 17 wherein said elongate members are made of a mercury wettable material and said tubing is made of a non-mercury wettable material.

19. The position insensitive mercury relay switch of claim 17 wherein said tubing is made of a magnetically soft material.

20. The position insensitive mercury relay switch of claim 16 wherein each of said grooves is formed in said flat surface of each of said elongate members, further wherein said flat surfaces are joined with the grooves in registry to form an internal channel in said armature.

21. The position insensitive mercury relay switch of claim 16 wherein each of said grooves is formed in the surface of said elongate member opposite to said flat surface, to thereby form external channels on said armature.

22. The position insensitive mercury relay switch of claim 17 wherein said tubing comprises a permanent magnet.

* * * * *